US008503689B2

(12) United States Patent
Schreuder et al.

(10) Patent No.: US 8,503,689 B2
(45) **Date of Patent: *Aug. 6, 2013**

(54) INTEGRATED MONOPHONIC HEADSET HAVING WIRELESS CONNECTABILITY TO AUDIO SOURCE

(75) Inventors: Johannes Lucas Schreuder, Ees (NL); Jacobus Cornelis Haartsen, Hardenberg (NL)

(73) Assignee: Plantronics, Inc., Santa Cruz, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/249,752

(22) Filed: Sep. 30, 2011

(65) Prior Publication Data

US 2012/0093334 A1 Apr. 19, 2012

Related U.S. Application Data

(60) Provisional application No. 61/393,829, filed on Oct. 15, 2010.

(51) Int. Cl.
*H04R 1/10* (2006.01)

(52) U.S. Cl.
USPC ..... 381/74

(58) Field of Classification Search
USPC ..... 381/74
See application file for complete search history.

(56) References Cited

U.S. PATENT DOCUMENTS 5,982,904 A * 11/1999 Eghtesadi et al. ..... 381/74
6,055,312 A 4/2000 Pralus et al.
7,187,948 B2 3/2007 Alden
D630,186 S 1/2011 Yang
8,094,859 B2 * 1/2012 Suematsu et al. ..... 381/384
2001/0049262 A1 12/2001 Lehtonen
2004/0240695 A1 * 12/2004 Leedom et al. ..... 381/328
2005/0195988 A1 * 9/2005 Tashev et al. ..... 381/92
2007/0076897 A1 4/2007 Philipp
2007/0098192 A1 * 5/2007 Sipkema ..... 381/312
2007/0213783 A1 * 9/2007 Pless ..... 607/42
2007/0287380 A1 * 12/2007 Hui et al. ..... 455/41.1
2008/0311966 A1 12/2008 Klein
2008/0317105 A1 12/2008 Cohen et al.
2009/0109117 A1 * 4/2009 Johansson et al. ..... 343/876
2010/0007564 A1 * 1/2010 Hill et al. ..... 343/702
2010/0273441 A1 * 10/2010 Dubash et al. ..... 455/192.2
2011/0017545 A1 * 1/2011 Pompei ..... 181/296
2011/0116675 A1 * 5/2011 Terlizzi et al. ..... 381/384
2011/0317844 A1 * 12/2011 Schreuder et al. ..... 381/71.6
2012/0052810 A1 * 3/2012 Schreuder et al. ..... 455/41.3
2012/0087510 A1 * 4/2012 Sampimon et al. ..... 381/74
2012/0189136 A1 * 7/2012 Brown et al. ..... 381/74

OTHER PUBLICATIONS

PCT International Search Report, mailed Sep. 30, 2011, in connection with International Application No. PCT/NL2011/050459.
PCT Written Opinion, mailed Sep. 30, 2011, in connection with International Application No. PCT/NL2011/050459.
Motorola Bluetooth Active Headphones S9 MotoManual, Manual No. 6809507A77-0 Motorola, Inc., 2007.
Plantronics BackBeat 903/906 User Guide, 81378-03 Rev. B, Plantronics B.V., 2009.

* cited by examiner

*Primary Examiner* — Brian Ensey
*Assistant Examiner* — Katherine Faley
(74) *Attorney, Agent, or Firm* — Kenneth B. Leffler

(57) ABSTRACT

A wireless monophonic headset device has one ear piece, a control box, and a cable in between. The ear piece comprises a speaker and a battery. The control box includes circuitry including a short-range radio transceiver and a codec. The ear piece battery is connected to supply power to the control box circuitry by means of the cable.

16 Claims, 11 Drawing Sheets

INTEGRATED MONOPHONIC HEADSET HAVING WIRELESS CONNECTABILITY TO AUDIO SOURCE

CROSS REFERENCE TO RELATED APPLICATIONS

This application claims the benefit of U.S. Provisional Application No. 61/393,829, filed Oct. 15, 2010, which is hereby incorporated herein by reference in its entirety.

BACKGROUND

The present invention relates generally to electronic devices, such as electronic devices for engaging in voice communications and listening to music, and/or broadcast radio programs (e.g., the news). More particularly, the invention relates to a wireless headset with increased wearing comfort.

Mobile and/or wireless items of electronic devices are becoming increasingly popular and are in wide-spread use. In addition, the features associated with certain types of electronic devices have become increasingly diverse. To name just a few of many possible examples, electronic device functionality includes picture-taking ability, text messaging capability, Internet browsing functionality, electronic mail capability, video playback capability, audio playback capability, image display capability, and navigation capability.

Electronic devices, such as digital music players (e.g., those capable of reproducing audio output from mp3 or other format files), mobile (smart) phones, and portable Personal Computers like netbooks and laptops have become a significant part of many people's everyday experiences. To make these experiences as pleasing as possible, it is desirable that the electronic devices be easy to use. The user experience of these electronic devices is enhanced considerably by wireless headsets that allow the user to freely engage in voice communications without being tethered to a portable but not wearable host device like, for example, a smart phone or netbook.

Wireless monophonic ("mono") headsets applying Bluetooth® technology are used extensively to interact with mobile phones for voice applications. Car legislation on hands-free calling has been part of the success of such voice headsets. Such headsets are traditionally made to provide audio output to just one of the user's ears, making them by definition capable of providing only monophonic information.

The success of a wireless headset lies in its ergonomic factors, including how easily it can be handled (e.g., put on/taken off, accepting calls), how comfortable it is when worn, and how the wearing is perceived by people around the user. Other factors like audio performance, and the convenience of recharging are also of importance. Current wireless mono headsets do not offer form factors that fulfill one or more of these ergonomic factors. Improved designs are therefore desirable.

SUMMARY

It should be emphasized that the terms "comprises" and "comprising", when used in this specification, are taken to specify the presence of stated features, integers, steps or components; but the use of these terms does not preclude the presence or addition of one or more other features, integers, steps, components or groups thereof.

In accordance with one aspect of the present invention, the foregoing and other objects are achieved in a wireless headset device comprising only one ear piece comprising a speaker. The headset device also includes a control box comprising control box circuitry; and a first cable connected at one end to the ear piece and connected at another end to the control box. The control box circuitry comprises a short-range radio transceiver and a codec; and the ear piece further comprises a first battery connected to supply power to the control box circuitry by means of the first cable.

In some but not necessarily all embodiments, the control box further comprises a second battery connected to supply power to the control box circuitry. In some but not necessarily all of such embodiments, the batteries in the ear piece and the control box are electrically connected in parallel.

In some but not necessarily all embodiments, the control box circuitry comprises an FM radio.

In some but not necessarily all of the embodiments including the FM radio, the headset device further comprises a second cable attached to the control box, and the first cable and second cable are configured to be used together as an antenna for the FM radio. In some but not necessarily all of these embodiments, the combined length of the first and second cables is optimized for reception of FM radio signals at approximately 100 MHz.

In some but not necessarily all of the embodiments that use the first and second cables together as an antenna for the FM radio, the first and second cables are isolated from one another with respect to radiofrequency signals.

In some but not necessarily all of the embodiments that use the first and second cables together as an antenna for the FM radio, one of the first and second cables is configured for use as an antenna for the short-range radio transceiver.

In some but not necessarily all embodiments of the headset device, the control box comprises a microphone configured to supply microphone output signals to the codec. In some but not necessarily all of these embodiments, output signals from the codec are supplied to the short-range radio transceiver, the short-range radio transceiver being configured to wirelessly communicate information contained in the codec output signals to a host device.

In some but not necessarily all embodiments of the headset device, the first cable is configured for use as a first part of the antenna for the short-range radio transceiver, and the control box includes a casing that forms a second part of the antenna for the short-range radio transceiver. In some but not necessarily all of these embodiments, the length of the first cable is optimized for transmission and reception of radio signals at 2.4 GHz.

In some but not necessarily all embodiments of the headset device, the control box circuitry further comprises a power management unit; the first cable comprises two wires coupled to convey power from the first battery to the power management unit; and the first cable comprises an additional two wires coupled to carry analog audio signals between the speaker and the control box circuitry.

In some but not necessarily all embodiments of the headset device, the first cable comprises two wires for supplying the power from the first battery to the control box circuitry; and the device comprises circuitry for communicating audio information in digital form from the control box circuitry to circuitry in the ear piece via the two wires in the first cable.

In some but not necessarily all embodiments of the headset device, the ear piece includes a noise cancellation/suppression microphone; and the device comprises circuitry coupled to receive signals from the noise cancellation/suppression microphone and is configured to cancel/suppress noise from an audio signal to be generated by the speaker. In some but not necessarily all of these embodiments, the microphone is an in-ear microphone.

In some but not necessarily all embodiments of the headset device, the device further comprises a first microphone for generating a first microphone signal from sensed acoustic energy; a second microphone for generating a second microphone signal from sensed acoustic energy; and beamforming circuitry coupled to receive the first and second microphone signals and to constructively combine components of the first and second microphone signals that are associated with a source of acoustic energy, and to destructively combine all other components of the first and second microphone signals.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION

The various aspects of the invention will now be described in detail in connection with a number of exemplary embodiments. To facilitate an understanding of the invention, some aspects of the invention may be described in terms of sequences of actions to be performed by elements of a computer system or other hardware capable of executing programmed instructions. It will be recognized that in each of the embodiments, the various actions could be performed by specialized circuits (e.g., analog and/or discrete logic gates interconnected to perform a specialized function), by one or more processors programmed with a suitable set of instructions, or by a combination of both. The term "circuitry configured to" perform one or more described actions is used herein to refer to any such embodiment (i.e., one or more specialized circuits and/or one or more programmed processors). Moreover, the invention can additionally be considered to be embodied entirely within any form of computer readable carrier, such as solid-state memory, magnetic disk, or optical disk containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments as described above may be referred to herein as "logic configured to" perform a described action, or alternatively as "logic that" performs a described action.

In the present document, embodiments are described primarily in the context of a portable radio communications device, such as an illustrated mobile telephone. It will be appreciated, however, that the exemplary context of a mobile telephone is not the only operational environment in which aspects of the disclosed systems and methods may be used. Therefore, the techniques described in this document may be applied to any type of appropriate electronic host device, examples of which include a mobile telephone, a media player, a gaming device, a computer, a pager, a communicator, an electronic organizer, a personal digital assistant (PDA), a smart phone, a portable communication apparatus, remote display device, etc.

Figure 1A:
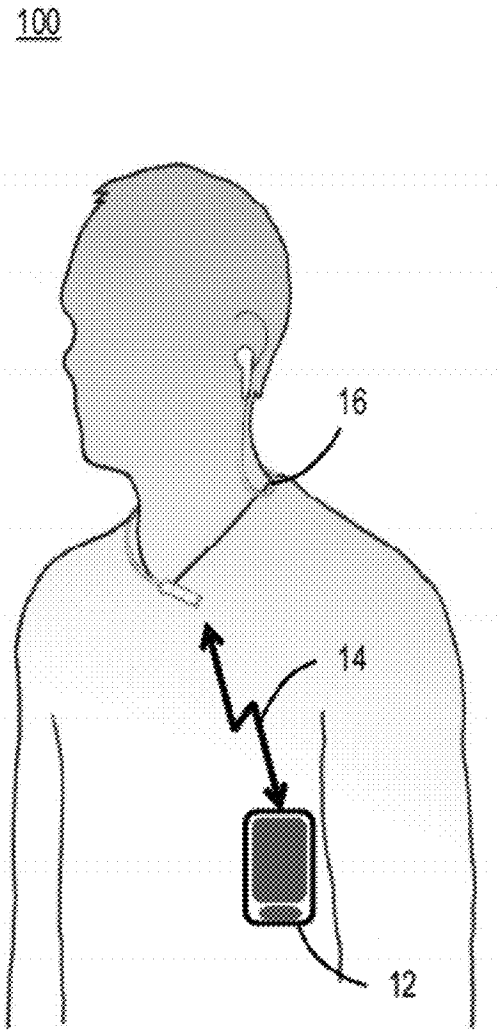
FIGS. 1*a*, 1*b*, and 1*c* are schematic diagrams of exemplary use scenarios of a particular user using a host device like a mobile phone and a wireless voice headset according to aspects of the invention.
Figure 1B:
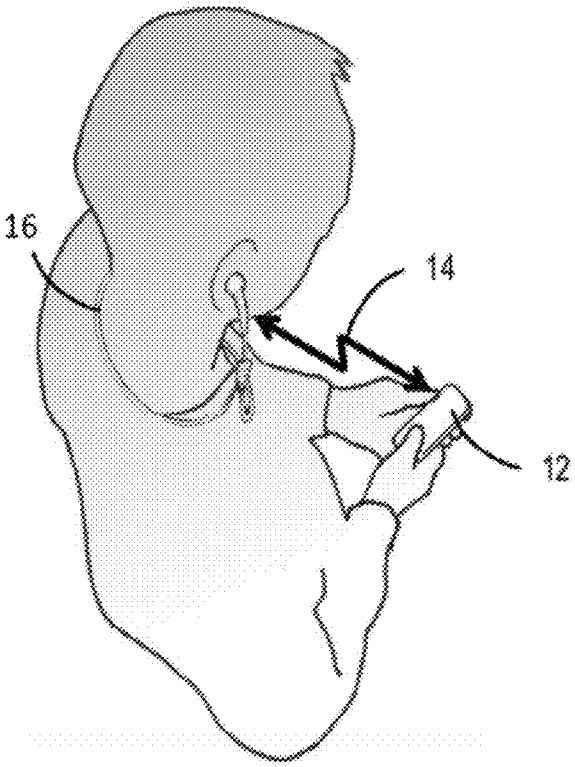
Figure 1C:
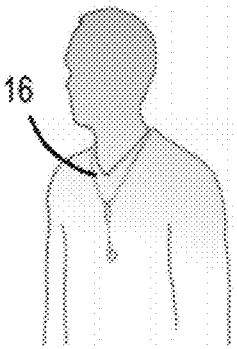

Electronic devices, such as mobile phones, are in widespread use throughout the world. Although the mobile phone was developed for providing wireless voice communications, its capabilities have been increased tremendously. Modern (smart) phones can access the worldwide web, store a large amount of video and music content, include a lot of applications ("apps") that enhance the phone's capabilities, provide an interface for social networking, and can even receive FM radio channels. Preferably, a phone has a large screen with touch capabilities for easy user interaction. However, having a large screen makes the phone less attractive for any interaction involving the user's ears, such as voice communications and listening to FM radio. For those applications, the phone (or any other host device) preferably remains in a pocket or bag, and the user enjoys the applications through a small-size, wireless and wearable headset. Alternatively, the user can interact with the touch screen or buttons on the phone while simultaneously carrying on a voice call or listening to FM radio. An example of such a user scenario 100 is shown in FIGS. 1*a*, 1*b*, and 1*c*. Host device 12 is a device that contains audio content which it can stream over a wireless connection 14 to a headset 16. In use, the user has the ear piece in his ear; when not in use ("idle"), the headset hangs via a necklace or is clipped to clothing via a clip.

Figure 2B:
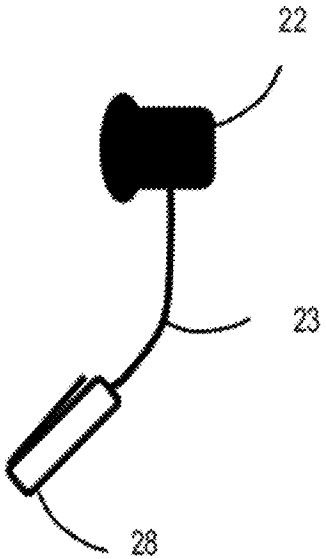
FIGS. 2*a* and 2*b* are schematic diagrams of exemplary wireless mono headsets according to aspects of the invention.
Figure 2A:
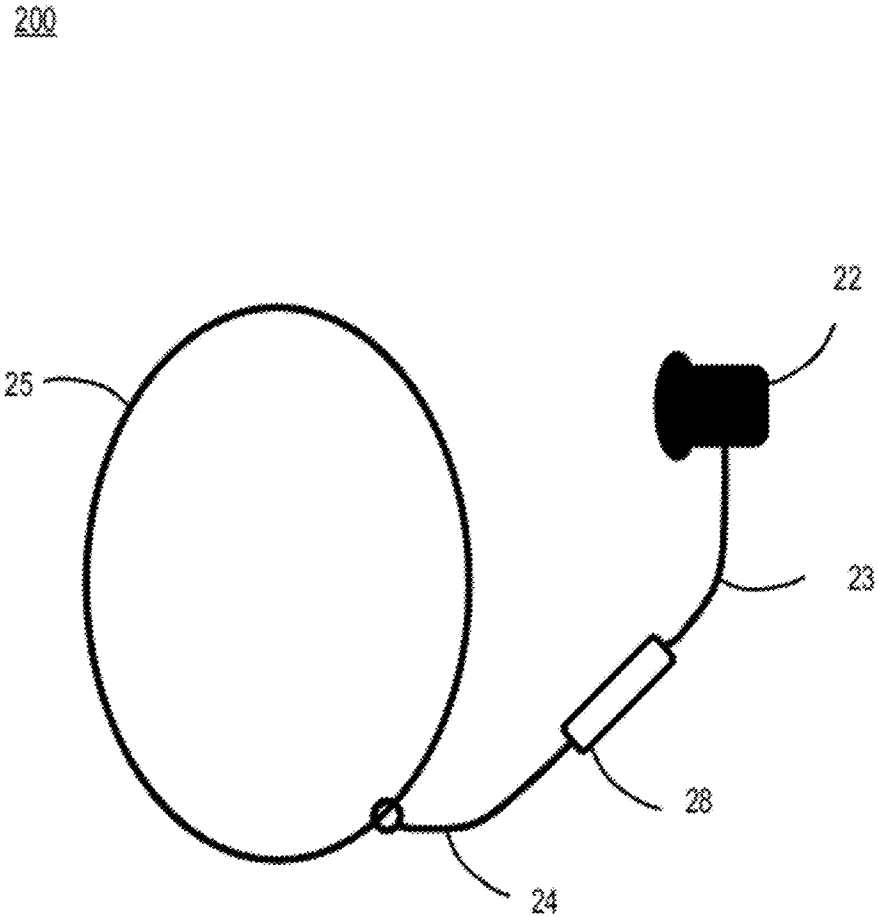

In FIGS. 2*a* and 2*b*, a headset embodiment 200 is shown according to aspects of the invention. The displayed headset combines a number of features that enhance the user experience:

- Comfortable wearing experience when in use (e.g., non-protruding ear piece). Such comfort factors are exemplified by, but not required to be, such things as, for example, minimum alteration of the user's appearance (i.e., the headset is so small that, from a front view, no protrusion of the ear pieces is visible); only a thin wire coming out from the ear pieces; while resting one's head on a pillow, there is no discomfort wearing the headset.

Comfortable wearing experience when in idle mode (e.g. the necklace or clip provides ease of carrying the headset while not in use—can be combined with jewelry)

Easy transition between idle and in-use: when there is an incoming call, the user can accept the call quickly since the position of the headset is known Acceptable FM radio reception with performance being predictable because the antenna is in a fixed position with respect to the body and the head while wearing the headset (in contrast to a wired headset in which the performance of the antenna embedded in the wire to the phone can vary considerably depending on the way of carrying the phone).

Proper position of the microphone with respect to the user's mouth for optimal voice pickup.

The headset comprises three individual entities: an ear piece 22, a control box 28, and a first cable 23 connecting one or more elements within the ear piece 22 to one or more elements within the control box 28. A necklace method (FIG. 2*a*) or clip method (FIG. 2*b*) can be used for wearing the headset when it is idle.

Figure 3:
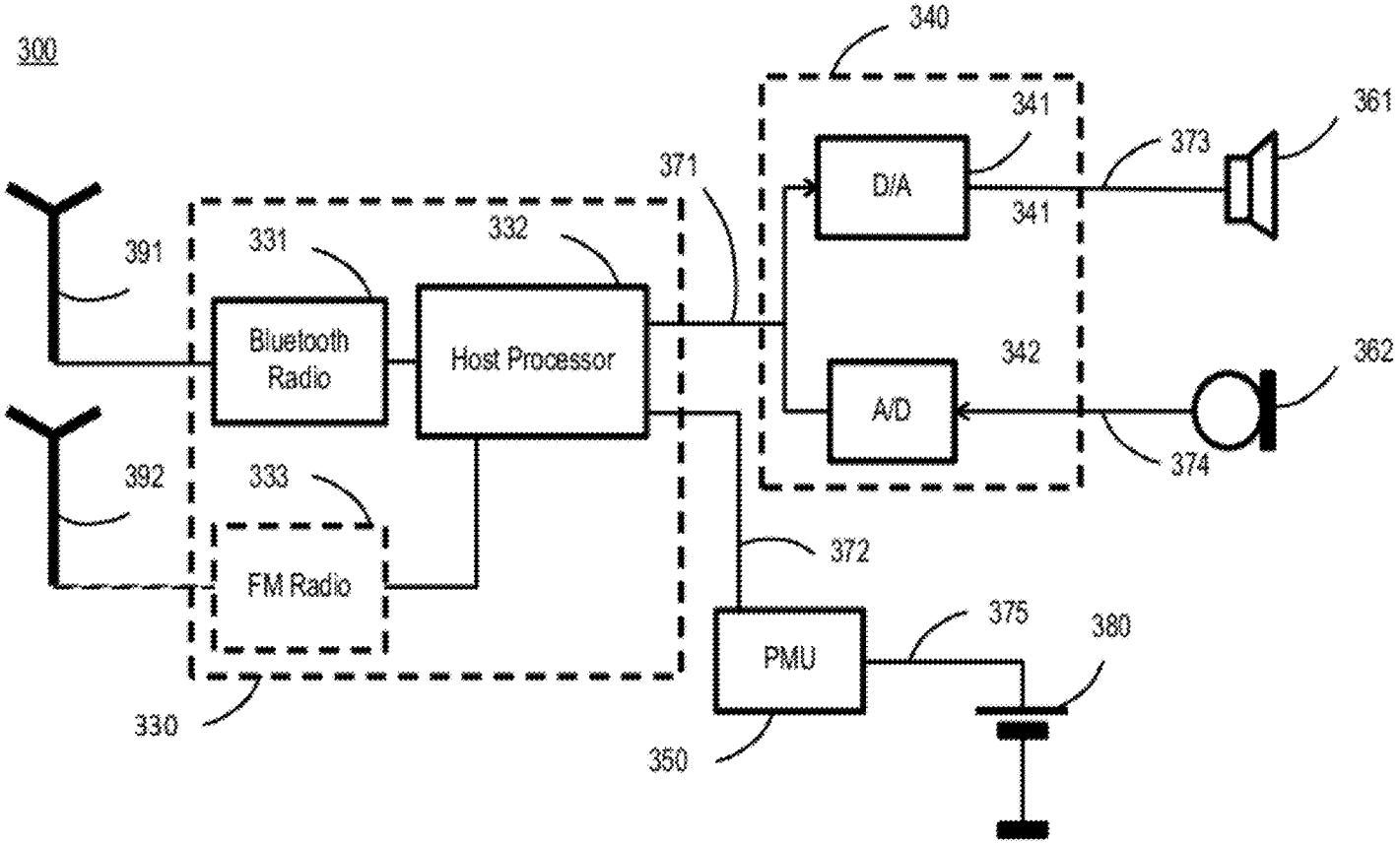
FIG. 3 is a schematic block diagram of relevant portions of an exemplary wireless headset consistent with embodiments of the invention.

FIG. 3 shows a generalized block schematic 300 of a mono wireless headset. Wireless communication between the telephone (or any other host device) and the headset is provided by an antenna 391 and a radio transceiver 331. The latter is a low-power radio covering short distances, for example a radio based on the Bluetooth® standard (operating in the 2.4 GHz ISM band). The use of a radio transceiver 331, which by definition provides two-way communication capability, allows for efficient use of air time (and consequently lower power consumption) because it enables the use of a digital modulation scheme with an automated repeat request (ARQ) protocol.

A host processor 332 controls the radio and applies audio processing (for example voice processing like echo suppression) to the signals exchanged with the radio transceiver 331. In addition to a short-range radio transceiver 331, some but not necessarily all embodiments include an FM radio receiver 333 coupled to a second antenna 392 in order to receive FM signals (typically in the 76-108 MHz band). The radio(s) 331, 333 and host processor 332 are preferably integrated into the same (e.g., silicon) chip 330.

The digital audio signals are carried over an audio interface 371 (for example a PCM interface) between the host processor 332 and a codec 340. The codec 340 includes a Digital-to-Analog (D/A) converter 341. The output of the D/A converter 341 connects to a speaker 361. Codec 340 further includes an Analog-to-Digital (A/D) converter 342 that receives an input signal from a microphone 362. As is well known in the art, a "speaker" transduces electrical signals into acoustic signals, and a "microphone" transduces acoustic signals into electrical signals. These connections are made via wires 373 and 374, respectively. To avoid cluttering the figure, ground wires for the speaker and microphone are not shown. A Power Management Unit (PMU) 350 provides the stable voltage and current supplies for all electronic circuitry. The PMU 350 is controlled by the host processor 332 via a data interface 372 (for example an I2C interface). The data interface 372 is also used to communicate between the host processor 332 and the codec 340. Finally, all power in the device is delivered by a battery 380, which typically provides a 3.7V voltage. The supply current is carried over a wire 375 (a ground wire is not shown). The battery 380 can be a primary battery or a rechargeable battery.

A first embodiment of a wireless headset 400 consistent with aspects of the invention is shown in FIG. 4. The speaker 361 is located in the ear piece 22. The battery 380 of FIG. 3 is also located in the ear piece 22. Depending of the size of the ear piece, the capacity of battery 380 for example ranges between 40 and 80 mAh.

In yet other alternatives, a second battery can be located in the control box 28 in addition to the battery in the ear piece 22. By providing total battery functionality in the form of a plurality of distinct physical batteries, a smaller overall form factor can be obtained. Alternatively, by using a plurality of distinct physical batteries, the overall power capacity can be bigger, while maintaining an acceptably small size of the individual elements that the physical batteries are placed in. For example, a mono headset containing a battery of 40 mAh in the each ear piece 22 and a battery of 40 mAh in the control box 28 is more attractive than a headset containing a single battery of 60 mAh in the ear piece 22 (or control box 28). In the first option, the ear piece and control box can be smaller, yet the overall power capacity has increased. Ear pieces usually have a round form factor which is also the form factor that gives the highest energy density for batteries.

From an electrical point of view, the batteries are connected in parallel. This has the advantage of allowing an easy recharge mechanism because only a single recharging point is required. However, parallel connection of the batteries is not an essential aspect of the invention. In alternative embodiments, the batteries could be connected in series. In still other alternatives, the batteries need not be coupled to one another, but instead are each arranged to supply power to a corresponding distinct partition of circuitry within the headset. In this latter alternative, two separate charging points would be needed, but this may not be a problem when wireless charging is applied.

In yet another alternative embodiment, circuitry is provided that is connected to the batteries 380*a*, 380*b*, and that causes the batteries 380*a*, 380*b* to be switched from connection in parallel to connection in series when the battery voltage arrives below a threshold voltage (for example 2V). FIG. 4*b* is s schematic diagram showing exemplary switching circuitry for use in such embodiments. In normal operation, including when recharged, the batteries are connected in parallel. In the exemplary embodiment of FIG. 4*b*, this means that switch 472 is in position 1 and switch 474 is in position 1. However, during operation, the batteries are discharged which will result in a decrease of the battery voltage. For example, typical rechargeable batteries have a voltage of 4V when fully charged. During operation, the voltage slowly drops. When the voltage drops below say 2V, the product is usually turned off since all electronics require a minimum supply voltage (e.g. the PMU 350 may require a 2V input voltage to be able to provide a stable 1.8V supply voltage to the electronic circuitry). A sensing circuit 480 measures the battery voltage of the parallel configuration and changes the battery connection configuration to change to connection in series by controlling the position of the switches 472, 474 when the battery voltage drops below say 2V. By placing each switch 472, 474 in position 2, the batteries are connected in series. The combined series connection would raise the voltage entering the PMU 350 from 2V to 4V. In this way, battery life is prolonged. Voltage levels stated, only serve as an example; with other battery and electronic circuitry, other voltage levels could be needed. This technique can particularly be of interest when supercaps or goldcaps are used as an energy source. Other self-contained energy sources like fuel cells or alternative energy sources that harvest energy from the environment through, for example, light, motion, and/or temperature differences, could be considered and applied as well.

The battery or batteries provide power to the circuitry in the control box 28. Control box 28 contains all active components: the radio unit 330 (containing the radio transceiver 331, the host processor 332, and in some embodiments also the FM radio 333), the codec 340 (containing the A/D converter 342 and D/A converter 341), and the PMU 350. Since, in this particular embodiment, the control box 28 does not contain a battery, its size can be very small, which enhances the wearability of the headset 400. The control box 28 will also contain a microphone 362 for voice pickup. The length of cable 23 is such that when the ear piece 22 is placed in the user's ear, the microphone 362 in control box 28 is located in a favorable position with respect to the user's mouth for optimal voice pickup. To control the headset 400, button switching devices ("buttons") can be placed either in the control box 28 (not shown) or on the ear piece 22 (not shown). Buttons can be used to turn the wireless headset on and off, for volume control, for FM channel selection, and so on. Instead of buttons, a touch sensitive user interface (UI) may be applied (not shown).

The cable 23 contains a number of wires that carry power supply and (audio) signals. In this first exemplary embodiment, the total number of wires is limited to only four (4) wires: a positive battery wire (375), a negative battery wire (ground), an analog signal line for the speaker (373), and an analog ground for the speaker. The inventors recognize that in alternative embodiments, the number of wires per cable can be reduced to three (3) having the analog ground for the speaker being shared with the battery ground. This alternative embodiment has a detriment, however, in that the battery ground has too much series resistance. Consequently, glitches caused by the radio/electronic circuit would be noticeable in the audio signal. The four-wire embodiments avoid this problem.

One or more of the wires in cable 23 will also act as the antenna 391 for the Bluetooth® radio. For optimal transmission and reception, the length L23 of cable 23 is optimized for radio communications at 2.4 GHz. If FM radio reception is desired, a second cable 24 needs to be added to the control box 28. Cable 24 does not contain wires for (audio) signals or power. However, for radio functionality a metal wire may be present in cable 24 to act as one part of a radio antenna. If FM radio functionality is desired, one or more wires in cables 23 and 24 combined (e.g., by means of capacitive coupling) will act as the antenna 392 for the FM radio. If a necklace 25 is present, it will also form a part of the FM antenna. Proper electrical decoupling between the wires in cable 23 and the wires in cable 24 is required to obtain sufficient antenna efficiency at RF frequencies. Furthermore, impedance matching is needed where the wires connect into the control box 28 in order to achieve a proper separation between the RF signals on the one hand and the analog and power supply signals on the other hand.

Figure 5:
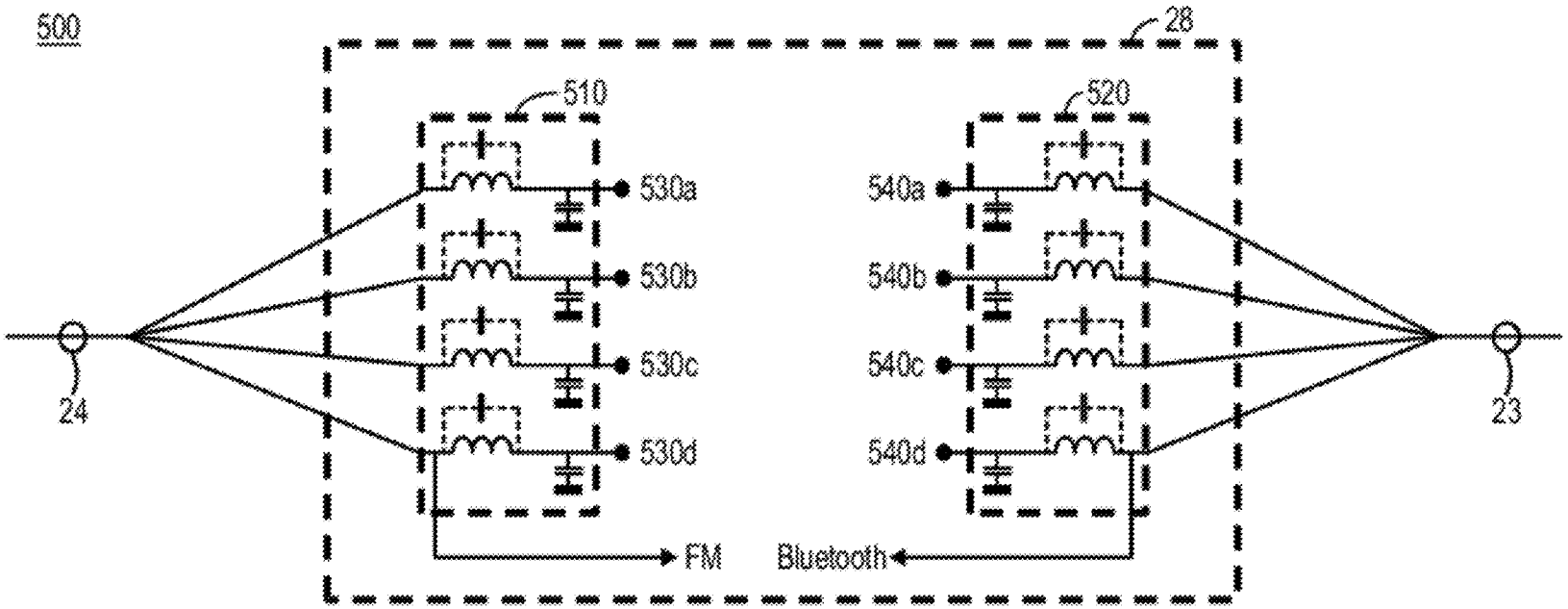
FIG. 5 is a schematic diagram illustrating an exemplary embodiment of a decoupling mechanism that can be employed in embodiments consistent with the invention.

An exemplary embodiment of the decoupling is depicted in the schematic diagram of FIG. 5. A dipole antenna is constructed for the FM radio 332. The second cable 24 is one side of the dipole. A bank of notch filters 510 is embedded in the control box 28 to suppress the FM signals picked up by the second cable 24. (Note that the 2.4 GHz signals can freely pass through this notch filter bank 510.) The notch filter bank 510 provides a barrier for the FM signals (around 100 MHz). The outputs of the notch filters 530*a-d* are practically grounded for the FM signals (e.g., the ground of the printed circuit board in the control box 28). The notch filters could be implemented by a combination of a high-pass filter and a low-pass filter.

A similar notch filter construction 520 is placed on the first cable 23, but now the notch frequency is tuned to the band of the short-range radio transceiver 331 (e.g., 2.4 GHz), so that the radio transceiver radio signal is suppressed but the FM signal is able to freely pass through. It is now understood that between node 550 and any node 530*a-d* or 540*a-d* (which are all ground), the FM signal can be derived. The FM antenna is practically a dipole antenna with the first cable 23 being one part of the antenna and the second cable 24 being another part of the antenna.

Figure 6:
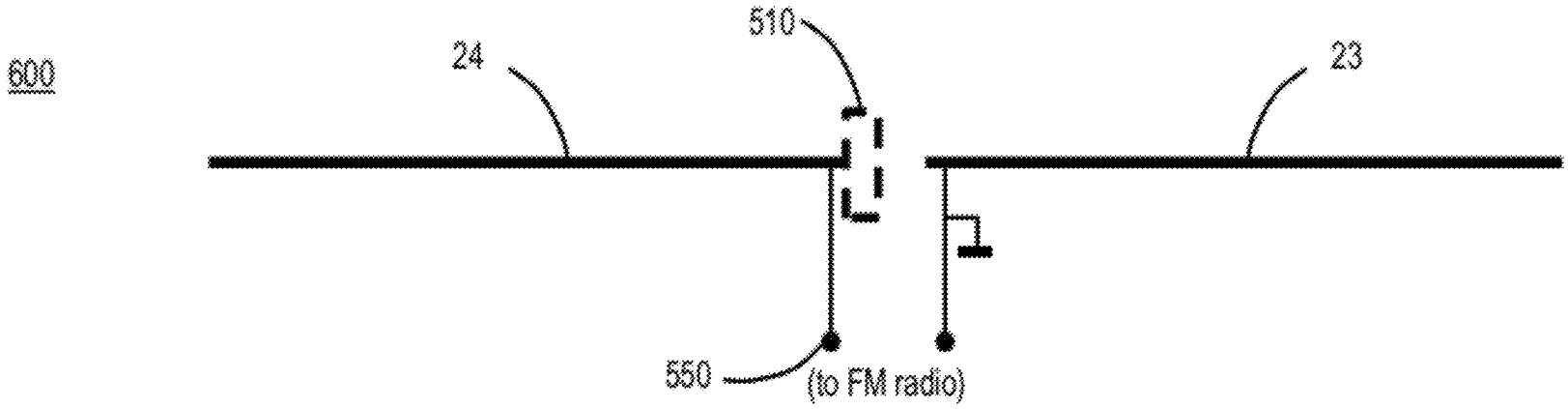
FIG. 6 is a schematic diagram illustrating the construction of a dipole antenna within a headset.

FIG. 6 is another schematic diagram illustrating this feature. This figure exemplifies the electrical schematics at FM frequencies (e.g., notch filter construction 520 is an electrical short-circuit for FM frequencies and is therefore not shown in FIG. 6). A similar situation is achieved for the radio transceiver's antenna (e.g., 2.4 GHz transceiver antenna). The radio transceiver's signal (e.g., 2.4 GHz signal) is present between the node 560 and any of the nodes 530*a*-3 or 540*a-d*.

Figure 7:
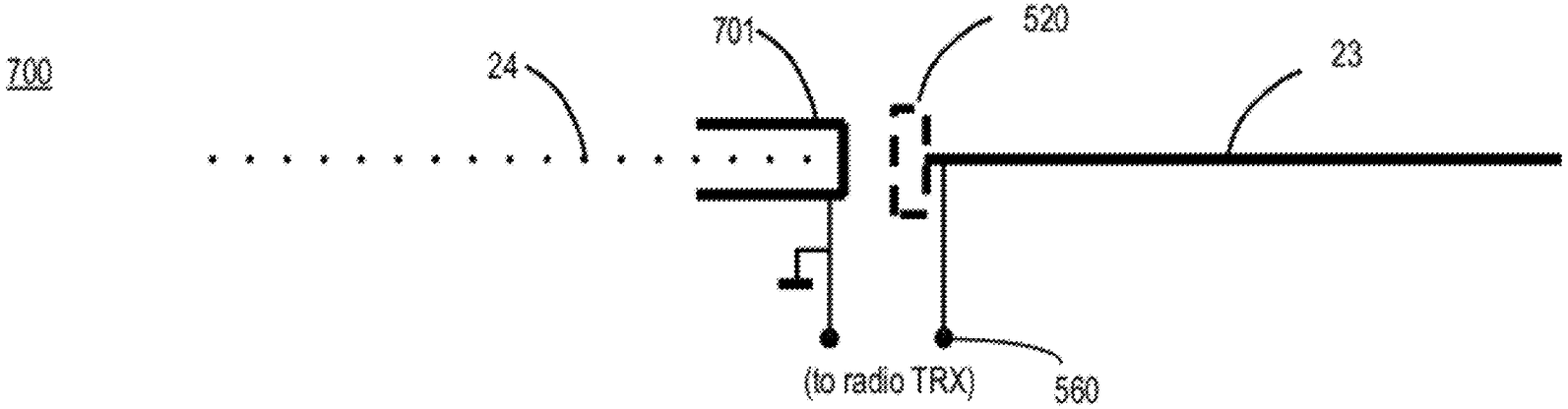
FIG. 7 illustrates an exemplary embodiment of a decoupler sleeve that can be employed in embodiments consistent with the invention.

The first cable 23 and second cable 24 could act as a dipole antenna for the short-range radio transceiver 331 operating at 2.4 GHz. In that case, the effective length of cables 23 and 24 should be close to half a wavelength or about 7 cm. However, in certain headset designs for comfortable wearing and/or jewelry appearances, the length of the second cable 24 may be too long for the radio transceiver's (e.g., 2.4 GHz) signals. Alternatively, cable 24 may not be present at all in case a clip-wearing method is adopted. (Because it is not present in all embodiments, the cable 24 is depicted in dotted lines in FIG. 7.) In those cases, a decoupler sleeve construction 701 is used as shown in FIG. 7. A sleeve 701 (e.g., made out of metal) constructed by the casing of the control box 28. This sleeve itself is grounded. The sleeve results in a high-impedance point on one side (e.g., on the left part of the sleeve). It therefore cancels the effect of the second cable 24 for the radio TXR signals (e.g., 2.4 GHz signals). Instead, the casing itself (sleeve) is used as one part of the dipole antenna (the casing can also be regarded as the ground plane of the antenna), while the first cable 23 is the other part of the dipole antenna. FIG. 7 exemplifies the electrical schematics at 2.4 GHz frequencies (e.g., notch filter construction 510 is an electrical short-circuit for 2.4 GHz frequencies and is therefore not shown in FIG. 7). If there is no second cable 24 present as in the clip-wearing method, the Printed Circuit Board in control box 28 will act as part of the antenna, and a sleeve construction using the casing would not be necessary.

The notch filter bandwidth of notch filter bank 510 is relatively wide and spans more than only the FM band ranging from 76 to 108 MHz. Therefore, in addition to suppressing FM signals, the notch filter bank 510 will also suppress signals in the high frequency (HF) and ultra-high frequency (UHF) bands. As a result, the electromagnetic compatibility (EMC) requirements on the electronic circuitry in box 28 are relaxed.

Since the FM antenna is embedded in the cable connecting the ear piece 22, the control box 28, and the necklace 25, a predictable and relatively constant FM performance is experienced.

The wire 375 that provides the power from the battery in the ear piece 22 to the electronics in control box 28 is connected to the PMU 350.

In yet other alternative embodiments, the number of wires in the cable 23 can be further reduced. This can be achieved by replacing the signal wires carrying the analog signals to the speaker 361 by a single wire carrying digital signals. This requires more electronic circuitry in the ear piece as is shown in the exemplary headset 800 depicted in FIG. 8. We now have a positive battery wire (375), a negative battery wire (ground), and a digital signal wire 820 (not shown). The negative battery wire will serve both for the power supply ground as well as for the digital signaling ground. A modem 810 is used to transfer the PCM audio data and control signaling information over the signal line 820. The modem could for example apply Bluetooth® baseband modulation. Note that codec functionality 340*b* (i.e. the D/A converter and the filtering) has been moved to the ear piece 22. Another codec function (A/D and filtering) is still provided as the codec 340*a* in the control box 28 to support the microphone functionality. In addition, PMUs 350*a*, and 350*b* are required in the control box 28 as well as in the ear piece 22 to provide stable voltages to the codecs and modems. In yet other alternative embodiments, no separate signal wire is used, but the digital signals are multiplexed on the positive battery wire 375 (with a single wire serving as both the digital signal ground and the power supply ground). In such embodiments, decoupling circuitry is needed to separate the DC power supply path from the digital signals.

In still other embodiments consistent with the invention, only a single wire is used in the cable 23 between the control box 28 and the ear piece 22. The wire only serves to provide antenna functionality for FM reception and wireless communications between the headset 16 and the host device 12. In this case, each of the elements (i.e., the ear piece 22 and the control box 28) is provided with its own power supply (i.e., a battery). Signaling between elements can be provided optically (e.g., using an optical fiber between the control box and the ear pieces) or wirelessly. In the latter case, capacitive coupling or a short-range radio could be used.

To further enhance user satisfaction with the headset, an easy-to-use method for recharging the batteries is desired. In some embodiments, this is achieved by placing connectors for recharging in either the ear piece 22 or in the control box 28. In yet other alternatives, a wireless charging mechanism is applied, either at the ear piece 22, at the control box 28, or in one or both cables 23, 24. If multiple batteries are used, they are preferably connected in parallel (for the DC path) such that a single wired or wireless recharging point suffices.

In yet other aspects of embodiments consistent with the invention, noise cancellation and noise suppression can be supported by placing additional microphones in the ear piece 22 (not shown). The additional microphones can be positioned on the ear piece part that is located within the ear canal and/or can be positioned on the ear piece part that is located outside the ear (the in-ear concept includes the case where the MIC is not physically located within the ear canal but is in direct contact to the air pressure in the ear canal via an small tube). When in-ear positioning is employed, the microphones can be used for near-end noise cancellation (so called because it benefits the user of the headset itself), that is, reducing the impact of environmental noise on the audio heard by the user. The voice played in the ear is picked up by the in-ear microphone and compared to the voice signal provided to the speaker. Any deviation is deemed to be noise that can be cancelled by using known noise cancellation techniques that rely on this feedback to adjust the signal supplied to the speaker. The audio processing for noise cancellation may be performed in the digital domain in a Digital Signal Processor (DSP) in control box 28. This DSP may, for example, be located in the host processor 332. Alternatively, the noise cancellation may be performed in the analog domain, for example in an analog circuit embedded in codec 340. Additional wires would be needed in cable 23 to carry the microphone signal from the ear piece 22 to control box 28. Alternatively, these signals are multiplexed over a shared wire as was discussed in the embodiment shown in FIG. 8.

The in-ear microphone can also be used for voice pick-up. Far-end noise suppression (so-called because it benefits the user on the other side of the line, not the wearer of the headset, by reducing the impact of environmental noise on the voice) is achieved by the isolation of the ear canal itself: the ear bud pushed inside the ear canal prevents environmental noise to reach the in-ear microphone. Special attention is required for echo cancellation in case of using in-ear microphones.

Noise suppression and noise cancellation can also be achieved with microphones positioned on the ear piece part that is located outside the ear. For near-end noise cancellation, feed-forward techniques can be used.

For far-end noise suppression, beam-forming can be used. In that case, multiple microphones will be needed. For example, a first microphone can be in the control box 28 while the second microphone is in the ear piece 22. In case of beam-forming, the information picked up by the first and second microphones needs to be combined. The concepts of noise cancellation and noise suppression can be implemented both in the embodiment of FIG. 4*a* as well as in the embodiment of FIG. 8. These kinds of audio processing functions are typically carried out by a digital signal processor (DSP). The DSP can be part of the host processor 332 in the control box 28 or in the configuration of FIG. 4*a*.

For beam-forming with multiple MICs, the information of both MICs needs to be combined. The signals from the MICs therefore need to be fed to a central unit (e.g., control box 28) so they can be combined. This would require additional wires in the configuration of FIG. 4*a*.

Figure 4A:
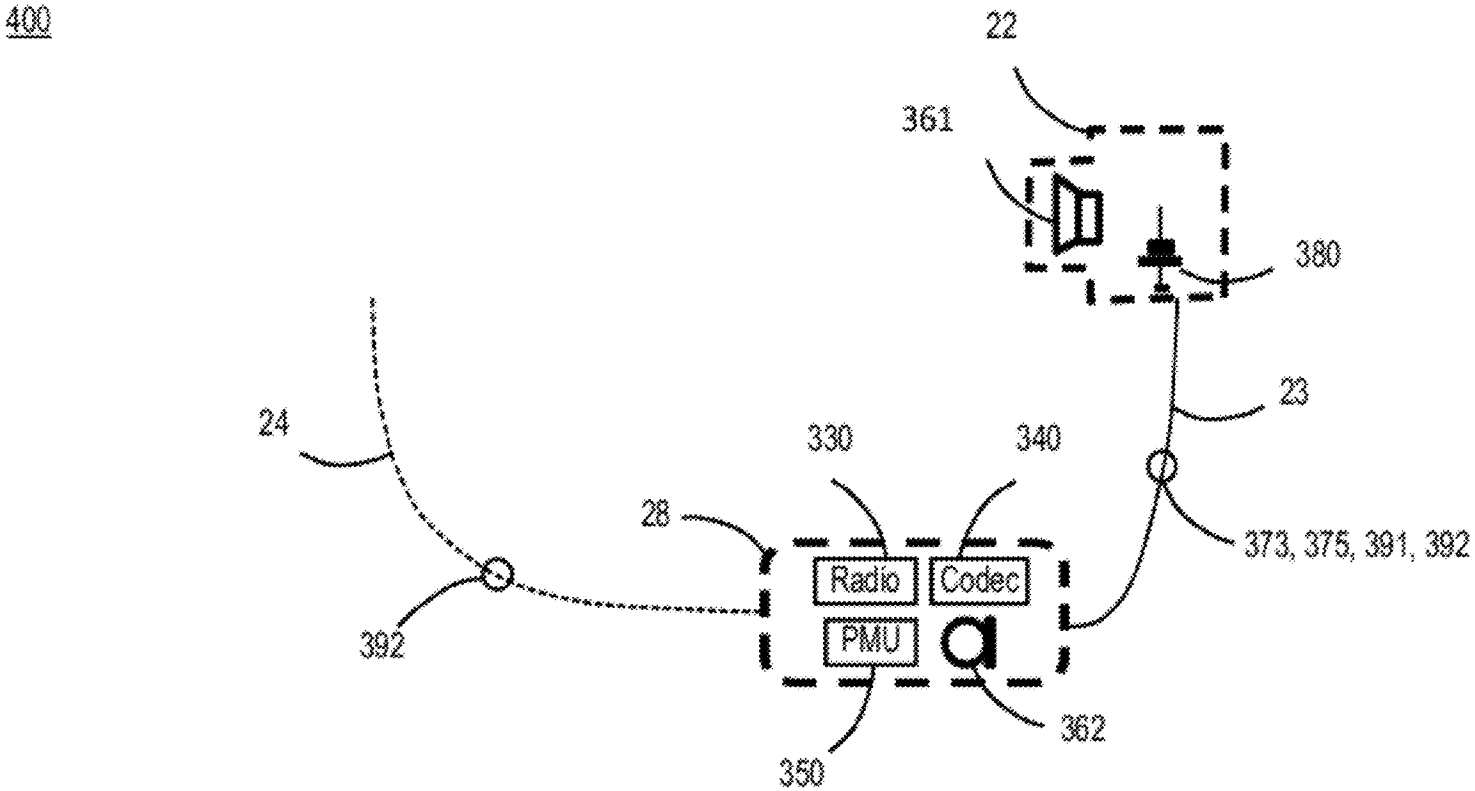
FIG. 4*a* is a detailed schematic diagram of a first embodiment consistent with aspects of the invention.
Figure 4B:
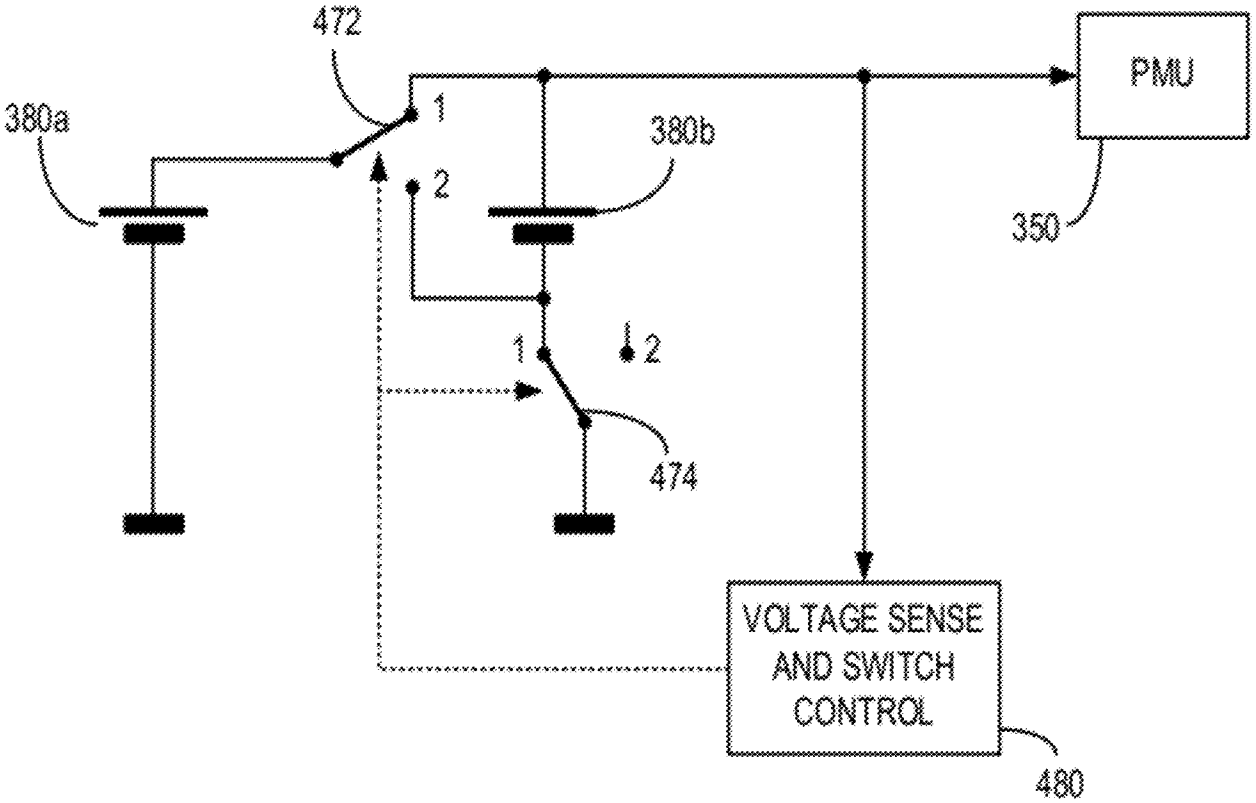
FIG. 4*b* is a detailed schematic diagram showing switching circuitry for switching between a parallel to series connection of two batteries consistent with aspects of embodiments of the invention.
Figure 8:
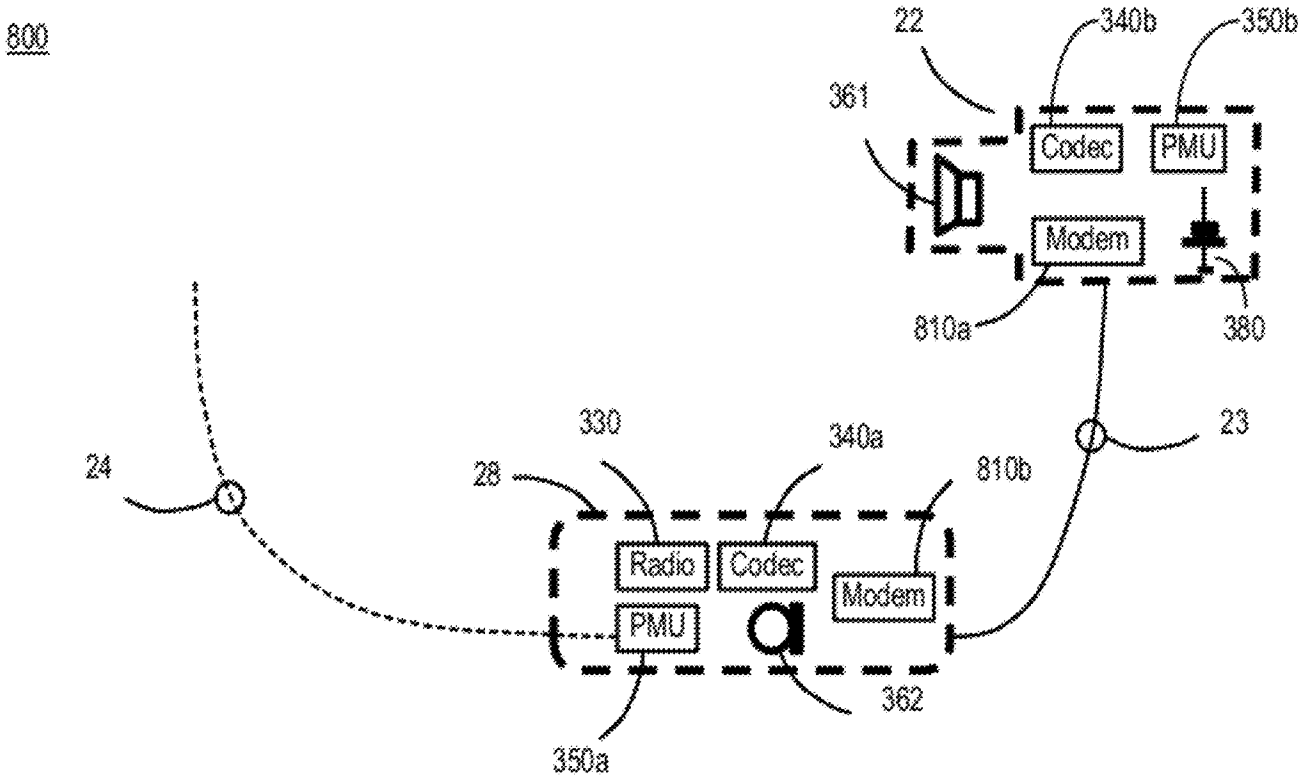
FIG. 8 is a detailed schematic diagram of a second embodiment consistent with aspects of the invention.

Since the timing information (phase) in the first and second MIC is critical, additional wires will be needed in cable 23 to support beam-forming in the embodiment of FIG. 4*a*. No additional wires are needed in the embodiment of FIG. 8, provided the microphones use a shared clock to sample the audio. The modems in such embodiments support bi-directional communications, for example by applying time-division multiplexing.

Figure 9:
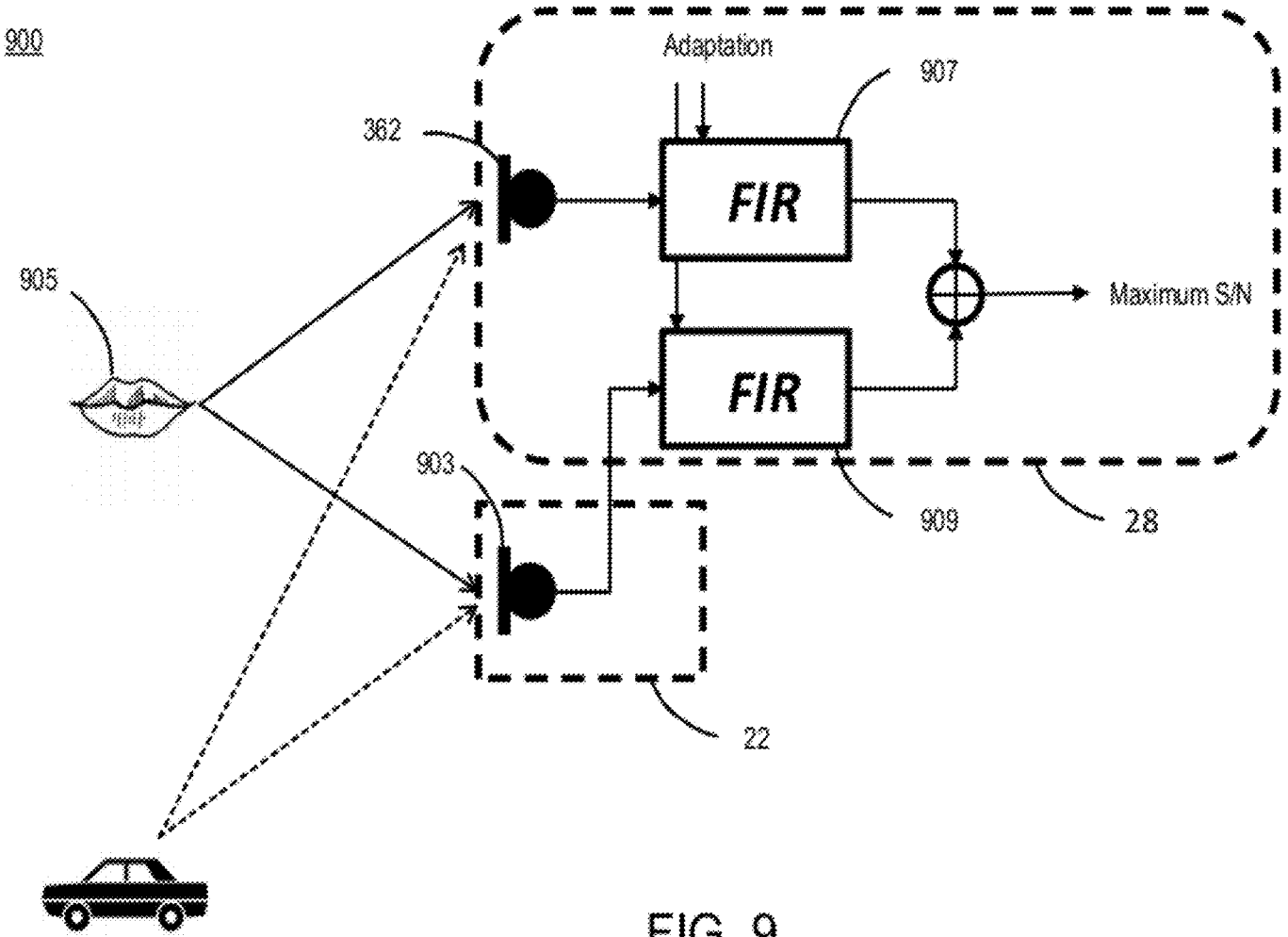
FIG. 9 illustrates beam-forming concepts that can be employed in embodiments consistent with the invention.

The discussion will now focus on noise suppression techniques. Noise suppression in (wireless) headsets uses two (or more) microphones. With two microphones, beam forming can be applied. FIG. 9 illustrates beam forming concepts. The signals arriving at the microphones 362, 903 are correlated. Knowledge of the phase difference between the signals originating from the same source and arriving at the microphones 362, 903 allows the signals to be combined constructively using audio filters in a processing unit. All other signals can be combined destructively so that they are suppressed as much as possible. This achieves a high differentiation between the desired signal and the undesired signals.

The direction of the desired source (e.g., speech source 905) needs to be known in order to get the proper phase relationships. Therefore, the source needs to be identified. To achieve this, the noise-suppression algorithm is configured to include a speech detection algorithm that identifies speech. When speech is detected, an adaptation algorithm is invoked to determine the phase relation for the voice source. This phase relation is then used to enhance the voice signal in the received signals from both microphones 362, 903. The noise suppression algorithm has a presetting based on the position of the microphones 362, 903 (at the ear and the control box) and the mouth. The algorithm tries to find the optimum spot of the mouth within a cone-shaped volume of space.

Each of two finite impulse response (FIR) filters 907, 909 receives signals from a respective one of the two microphones 362, 903. The FIR filters 907, 909 filter the microphone signals and provide the proper phase relationships. The FIR filter coefficients are variable. The coefficients determine both the amplitude and the phase response. An adaptive algorithm varies the coefficients such that a maximal signal-to-noise (S/N) or signal-to-interference (S/I) ratio is achieved.

In an alternative embodiment, the parameter settings of the FIR filters 907, 909 are not variable but fixed. This is particularly suitable for the mono headset with the necklace. In that case, the two MICs have predefined positions (one MIC at the ear position, and one MIC at the position hanging between the ear and the necklace). Based on these predefined positions, fixed parameters can be determined which are programmed in the FIR filters. This is also called Blind Source Separation (BSS).

In addition to audio functionality, the headsets shown may also include sensing capabilities. For example, the in-ear microphone placed in the ear piece for noise cancellation may also be used for the pickup of bio-signals such as, but not limited to, heart rate or breathing rate. These signals may be forwarded from the ear piece to the control box 28. The bio-signals can be processed by electronic circuitry in the control box 28 and/or can be communicated wirelessly from the headset to an external host device (e.g., a mobile phone or a personal computer) for processing.

Figure 10:
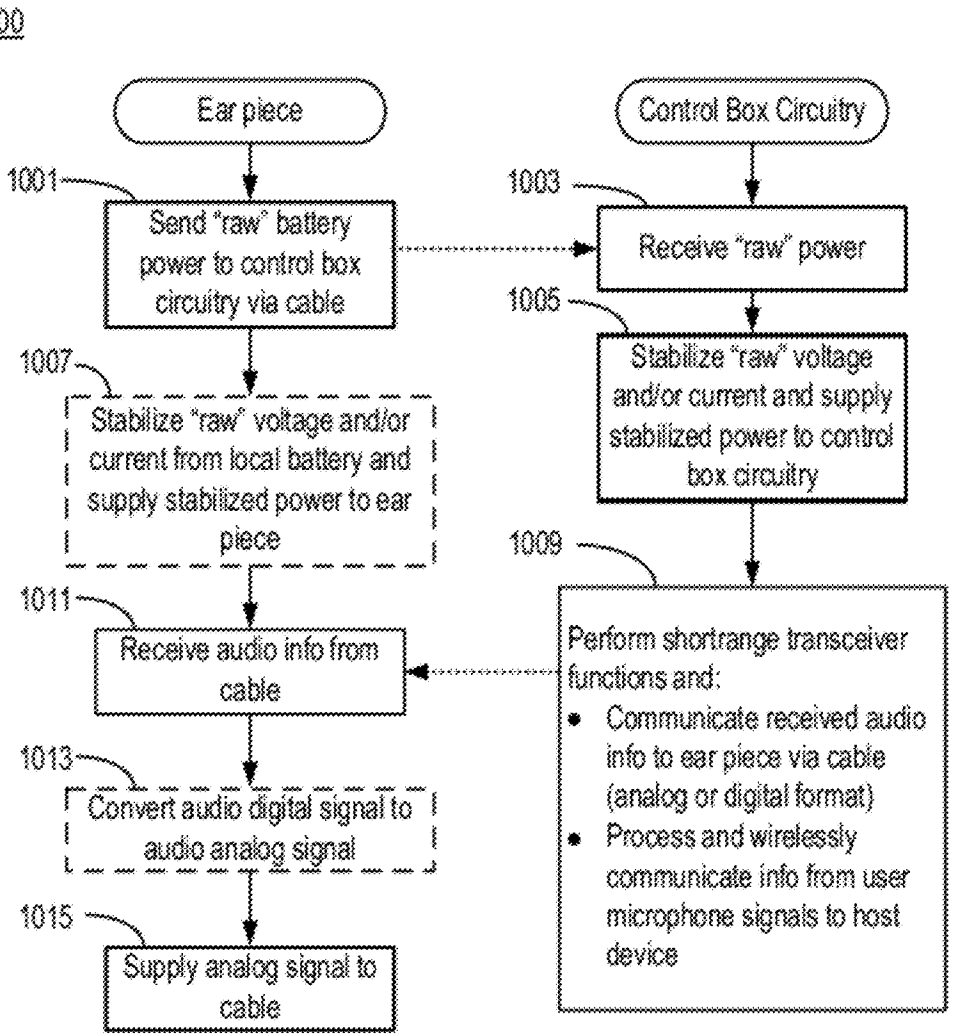
FIG. 10 is, in one respect, a flow diagram of steps/processes performed in accordance with one or more methods consistent with the invention.

FIG. 10 will now be described which is, in one respect, a flow diagram of steps/processes performed in accordance with one or more methods consistent with the invention. In another respect, FIG. 10 can be considered to schematically depict device circuitry 1000 comprising the illustrated functionally described components (i.e., means for performing the described functions).

To facilitate the reader's understanding, FIG. 10 is divided into two columns, with each individual column representing steps/processes/means, each associated with a corresponding single one of two distinct entities: the ear piece 22 and the control box 28. The description begins with the mechanism by which all of the device circuitry 1000 is powered. As mentioned earlier, the ear piece 22 includes a battery 380. This battery supplies unregulated power (referred to herein as "raw" power). Battery 380 sends its raw power to the control box circuitry (i.e., the various circuit elements contained within the control box 28) via the cable 23 (steps 1001). The control box circuitry (e.g., the PMU 350 or 350*a*) receives the raw power (step 1003), stabilizes the received voltage and/or current and supplies the stabilized voltage and/or current to control box circuitry (step 1005).

In some (but not necessarily all) embodiments, such as the embodiment depicted in FIG. 8, the ear piece 22 includes active circuitry that requires power. In such embodiments, the battery 380 also supplies its power to a respective one of the local PMUs 350*a*, 350*b* (i.e., local to the ear piece and local in the control box), in which case each of the control box circuitry and the ear piece 22 stabilizes its local raw voltage and/or current and supplies the stabilized power to its own local circuitry (steps 1005 and 1007).

The control box circuitry also performs short-range transceiver functions (step 1009), including:

- communicating received audio information, in analog or digital format, to the ear piece 22 via the cable; and
- processing and wirelessly communicating information from the microphone signals (e.g., generated by the microphone 362) to the host device 12.

The ear piece 22 receives its audio information from the cable 23 (step 1011). As mentioned earlier, different embodiments can employ this cable in different ways to communicate audio information from the control box circuitry to the ear piece 22. In some embodiments, analog signals are used and in others, digital signaling is used. In case of the latter, the ear piece circuitry further performs converting its audio digital signal into an audio analog signal (step 1013).

Regardless of whether analog or digital signaling is used along the cable, an analog signal is supplied to the speaker 361 (step 1015).

It will be appreciated that in various alternative embodiments, device circuitry can perform additional steps as well, such as those involved in receiving signals from the extra noise cancellation/suppression microphones (mentioned earlier) and processing those signals to cancel/suppress noise from an audio signal to be generated by the speaker 361.

The invention has been described with reference to particular embodiments. However, it will be readily apparent to those skilled in the art that it is possible to embody the invention in specific forms other than those of the embodiment described above.

The described embodiments are merely illustrative and should not be considered restrictive in any way. The scope of the invention is given by the appended claims, rather than the preceding description, and all variations and equivalents which fall within the range of the claims are intended to be embraced therein.

What is claimed is:

1. A wireless headset device comprising:

only one ear piece comprising a speaker;

a control box comprising control box circuitry, wherein the control box is separate from the ear piece; and a first cable connected at one end to the ear piece and connected at another end to the control box;

wherein:

the control box circuitry comprises a short-range radio transceiver and a codec; and the ear piece further comprises a first battery connected to supply power to the control box circuitry by means of the first cable, wherein the first cable is configured for use as an antenna for the short-range radio transceiver.

2. The device of claim 1, wherein the control box further comprises a second battery connected to supply power to the control box circuitry.

3. The device of claim 2, wherein the batteries in the ear piece and the control box are electrically connected in parallel.

4. The device of claim 1, wherein the control box circuitry comprises an FM radio.

5. The device of claim 4, further comprising a second cable attached to the control box, and wherein the first cable and second cable are configured to be used together as an antenna for the FM radio.

6. The device of claim 5, wherein the combined length of the first and second cables is optimized for reception of FM radio signals at approximately 100 MHz.

7. The device of claim 5, wherein the first and second cables are isolated from one another with respect to radiofrequency signals.

8. The device of claim 1, wherein the control box comprises a microphone configured to supply microphone output signals to the codec.

9. The device of claim 8, wherein output signals from the codec are supplied to the short-range radio transceiver, the short-range radio transceiver being configured to wirelessly communicate information contained in the codec output signals to a host device.

10. The device of claim 1, wherein the first cable is configured for use as a first part of the antenna for the short-range radio transceiver, and the control box includes a casing that forms a second part of the antenna for the short-range radio transceiver.

11. The device of claim 10, wherein the length of the first cable is optimized for transmission and reception of radio signals at 2.4 GHz.

12. The device of claim 1, wherein:

the control box circuitry further comprises a power management unit;

the first cable comprises two wires coupled to convey power from the first battery to the power management unit; and the first cable comprises an additional two wires coupled to carry analog audio signals between the speaker and the control box circuitry.

13. The device of claim 1, wherein:

the first cable comprises two wires for supplying the power from the first battery to the control box circuitry; and the device comprises circuitry for communicating audio information in digital form from the control box circuitry to circuitry in the ear piece via the two wires in the first cable.

14. The device of claim 1, wherein the ear piece includes a noise cancellation/suppression microphone; and the device comprises circuitry coupled to receive signals from the noise cancellation/suppression microphone and is configured to cancel/suppress noise from an audio signal to be generated by the speaker.

15. The device of claim 14, wherein the microphone is an in-ear microphone.

16. The device of claim 1, comprising:

a first microphone for generating a first microphone signal from sensed acoustic energy;

a second microphone for generating a second microphone signal from sensed acoustic energy; and beamforming circuitry coupled to receive the first and second microphone signals and to constructively combine components of the first and second microphone signals that are associated with a source of acoustic energy, and to destructively combine all other components of the first and second microphone signals.

* * * * *